US006425699B1

(12) United States Patent
Doval et al.

(10) Patent No.: US 6,425,699 B1
(45) Date of Patent: Jul. 30, 2002

(54) USE OF VERY SMALL ADVANCES OF PRINTING MEDIUM FOR IMPROVED IMAGE QUALITY IN INCREMENTAL PRINTING

(75) Inventors: Jose J Doval, Escondido, CA (US); Emiliano Bartolome, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/408,407

(22) Filed: Sep. 29, 1999

(51) Int. Cl.[7] ..... B41J 11/46
(52) U.S. Cl. ..... 400/582; 347/16
(58) Field of Search ..... 400/582, 545, 400/550, 568; 347/104, 101, 16

(56) References Cited

U.S. PATENT DOCUMENTS

| | | | | |
|---|---|---|---|---|
| 5,149,217 A | * | 9/1992 | Narita | 400/608.4 |
| 5,677,716 A | | 10/1997 | Cleveland | 347/37 |
| 5,777,638 A | * | 7/1998 | Salter et al. | 347/12 |
| 6,247,778 B1 | * | 6/2001 | Iwata | 347/16 |
| 6,250,734 B1 | * | 6/2001 | Otsuki | 347/16 |

* cited by examiner

*Primary Examiner*—Andrew H. Hirshfeld
*Assistant Examiner*—Charles H. Nolan, Jr.
(74) *Attorney, Agent, or Firm*—Ashen & Lippman

(57) ABSTRACT

A printhead scans to form marks in a multirow swath on the medium. A mechanism gives relative motion between the head and medium, orthogonal to the scan. Normal advance of the mechanism is at least several rows. There are variants or preferences: in one, the mechanism steps about a row or less to deliberately misalign successive swaths. There is best no associated data shift or normal advance. In another, the step roughly equalizes graininess between image regions with and without normal advance—e.g. between scans near at least one end of a page, to roughly equalize graininess as to swaths near and far from the end. The step best equals different fractions of a row, respectively, between successive swath pairs; these fractions progressively decrease—as e.g. programmed:

paperAdvance=Amplitude*cos(Frequency*nPasses+Phase);.

Preferably Amplitude is 7; Frequency is 0.2244; nPasses are increments from zero through 7; and Phase is zero. Another variant/preference: steps deliberately misalign successive swaths as to scans far from both page ends. Another has small-amplitude reciprocation—as a vibration or successive alternating-direction offsets. An oscillatory signal is injected into the scan or medium-advance drive signals.

41 Claims, 7 Drawing Sheets

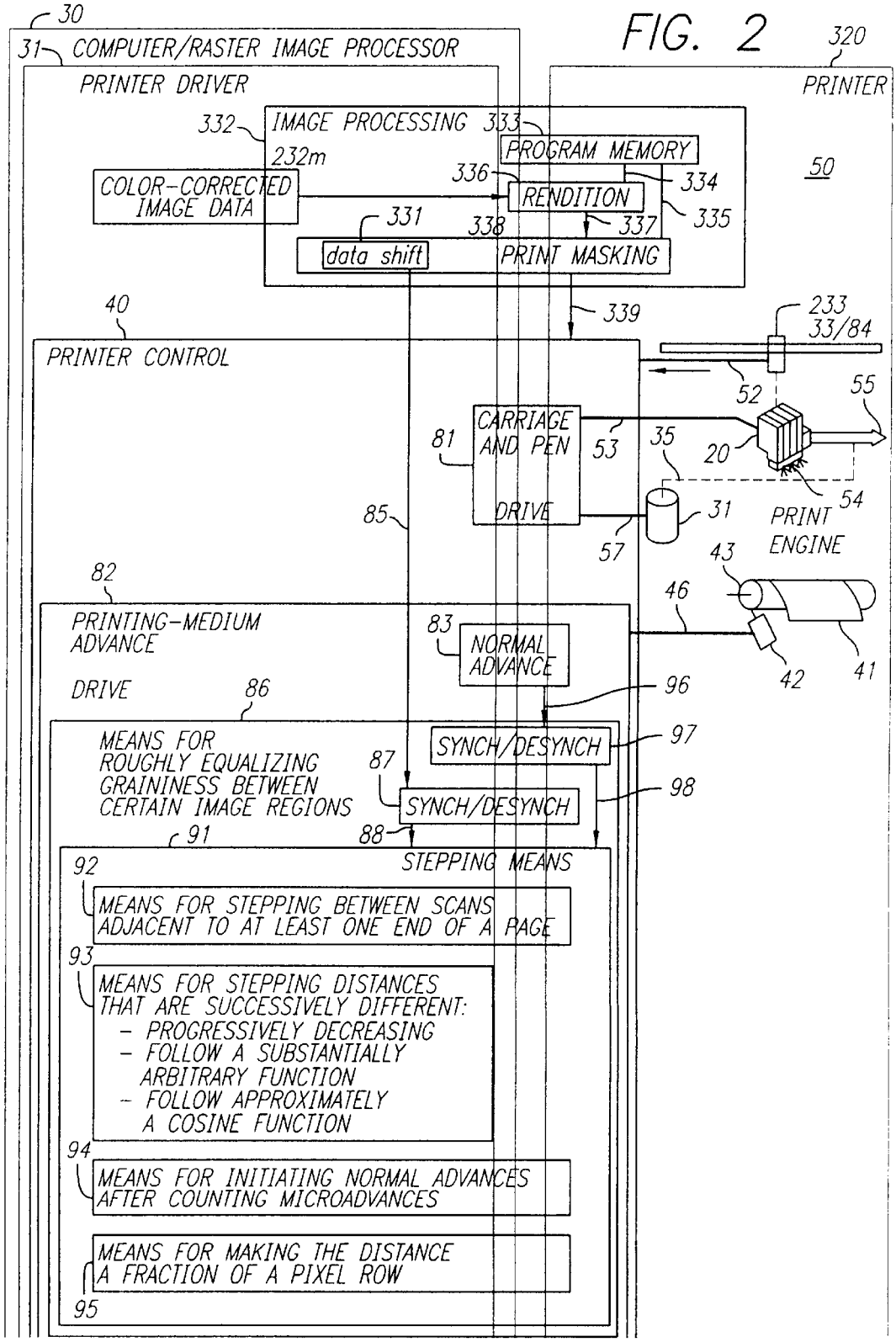
FIG. 2
30
31
COMPUTER/RASTER IMAGE PROCESSOR
PRINTER DRIVER
320
PRINTER
50
332
IMAGE PROCESSING
333
232m
PROGRAM MEMORY
336
334
COLOR-CORRECTED IMAGE DATA
RENDITION
335
331
338
337
data shift
PRINT MASKING
339
40
233
33/84
PRINTER CONTROL
52
55
81
CARRIAGE AND PEN DRIVE
53
35
20
54
85
31
PRINT ENGINE
57
43
82
46
PRINTING-MEDIUM ADVANCE DRIVE
83
NORMAL ADVANCE
42
41
96
86
MEANS FOR ROUGHLY EQUALIZING GRAININESS BETWEEN CERTAIN IMAGE REGIONS
SYNCH/DESYNCH
97
87
SYNCH/DESYNCH
98
88
91
STEPPING MEANS
92
MEANS FOR STEPPING BETWEEN SCANS ADJACENT TO AT LEAST ONE END OF A PAGE
93
MEANS FOR STEPPING DISTANCES THAT ARE SUCCESSIVELY DIFFERENT:
- PROGRESSIVELY DECREASING
- FOLLOW A SUBSTANTIALLY ARBITRARY FUNCTION
- FOLLOW APPROXIMATELY A COSINE FUNCTION
94
MEANS FOR INITIATING NORMAL ADVANCES AFTER COUNTING MICROADVANCES
MEANS FOR MAKING THE DISTANCE A FRACTION OF A PIXEL ROW
95

USE OF VERY SMALL ADVANCES OF PRINTING MEDIUM FOR IMPROVED IMAGE QUALITY IN INCREMENTAL PRINTING

RELATED PATENT DOCUMENTS

Closely related documents include other, coowned U.S. utility-patent documents, hereby incorporated by reference in their entirety into this document. Among these are U.S. Pat. No. 5,677,716 in the name of Cleveland, and application Ser. No. 09/252,141 in the name of Borrell and application Ser. No. 09/150,322 in the name of Garcia.

FIELD OF THE INVENTION

This invention relates generally to machines and procedures for printing text or graphics on printing media such as paper, transparency stock, or other glossy media; and more particularly to incremental machines and methods that construct text or images from individual ink spots formed progressively on a printing medium, in a pixel array—as for example by a scanning inkjet printer, or most other forms of matrix printing. The invention is directed to mitigation of several kinds of printing artifacts.

BACKGROUND OF THE INVENTION (a) Uneven graininess—One class of overall image-quality problems in incremental printing may take the curious form of image regions in which local image quality is overly good. This can be a problem because local image quality can be so much better than nearby image quality that the contrast between the two becomes conspicuous in itself.

This phenomenon has two adverse consequences. First, two adjacent regions can be so different in image character as to present a sort of banded appearance—a band of generally acceptable quality set next to a band of strikingly fine quality. The difference simply destroys the illusion of looking at a unitary image, calling attention instead to some unknown peculiarities of the reproduction process.

Second, the higher quality in one region calls into question what would otherwise be considered acceptable quality in the other region. In other words, a "good" region and a "better" region add up to dissatisfaction with the good region.

In some incremental-printing technologies such appearances arise, in particular, very near the top and bottom ends of a page, because distinctly different modes of printing are applied in those two regions as compared with all the image portions between. This behavior is a result of the inability of some incremental technologies to print a swath that is partially on the printing medium and partially off.

If the edge of the sheet lies partway along an inkjet printhead, for instance, and the printhead scans along the edge, ink applied by the head is likely to be smeared erratically by upward curling of the edge of the sheet. In some cases it is also possible to damage the nozzles.

To avoid such effects, the end zones of the sheet are printed with the printhead or "pen" entirely on the sheet. Since several passes are needed to print an image in any region, such operation requires that the several printing passes be made in sequence, but with no print-medium advance relative to the printhead.

Pure printmask rotation of the sweep type is used, instead of advance-type rotation, to complete the image in these end zones. The process is taken up in the previously mentioned patent of Cleveland.

Generally such operation produces somewhat clearer or less-grainy image quality than the more-typical advance rotation—in which a corresponding "normal" advance occurs between printing passes—employed in other parts of the sheet. This difference can give rise to the banding effects discussed above.

More generally, however, such banding effects can occur in any composite region that bridges subregions with and without normal advance. More generally still, such effects can occur in any printing process which uses distinctly different printing modes or techniques in immediately adjacent image regions.

Although elimination of these effects is highly desirable, the regions in which they appear are after all rather small, and literally peripheral. Hence it is extremely important that any methodology adopted to mitigate these artifacts pose a very minimal degree of disruption to the overall printing process—and also to the overall structure of the programming which controls that process.

(b) Better-known artifacts—Several other types of image-quality defects are well documented in the patent and other literature, and have been the subject of extensive corrective efforts. Yet as the modern competitive push continues toward ever higher photographic-quality images and ever faster but less expensive machines, such artifacts persist stubbornly—and newer, more economical and less disruptive techniques are always at a premium.

Some such artifacts arise very directly from defects in nozzle geometry or firing characteristics. These first-order defects include white space and double-printing—due to nozzles that are not printing or are misdirected.

Other artifacts, harder to understand and still harder to uproot, come from unfortunate combinations of those simple nozzle-to-nozzle defects with regularity in the printing process. These include portions of the progressive migrating patterns which develop in error diffusion.

They can also include the repetitive stepping of printmasks that are not large enough to escape from the repetition-sensitive angular range of the eye, as taught in the previously mentioned patent document of Garcia. On the other hand, as Garcia has also pointed out, the opposite of excessive regularity—namely, excessive randomness—can also lead to a different sort of artifact, namely undesirable visible granularity in an image.

Although all these defects can be managed very effectively by multipass printmode techniques and related tactics, those techniques and tactics in general levy a large price in terms of printing throughput. Such a penalty is increasingly less acceptable in the marketplace.

(c) Repetitive overprinting—Returning now to somewhat more-subtle difficulties, a problem that persists even in some sophisticated randomized printmasking schemes is repetitive overprinting of particular nozzles by specific other nozzles. In such situations the first-order problem of nozzle outages or misdirections is already eliminated by mixing inking by different nozzles in a single pixel row—and even within an individual pixel.

This stratagem, however, may be to no avail if it happens that two or three nozzles used in conjunction, in a given row or pixel, all happen to be malfunctioning similarly or complementarily. Of course such a result is statistically less prevalent, but still significant.

(d) Software-generated beats—Some repetitive visible effects originate in software-generated interferences. These include, for example, interactions between dither-mask and printmask periodicities as explained in the previously mentioned patent document of Borrell.

(e) Unrelated use of small advances—For completeness it is mentioned here that it has been known heretofore to advance the printing medium, in addition to the normal advance used between printing passes, by supplemental very small amounts. These supplemental advances—most typically many pixel rows, but in any event substantially greater than a single row—are strictly for the purpose of compensating known errors in mechanical positioning, and have not been employed to address any of the problems discussed above.

(f) Conclusion—These several difficulties have continued to impede achievement of uniformly excellent inkjet printing—at high throughput. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is apparatus for printing desired images on a printing medium, by construction from individual marks formed in pixel row-and-column arrays. The apparatus includes a printhead mounted for scanning motion to form marks in a multiple-pixel-row swath on the printing medium.

The apparatus also includes a printing-medium advance mechanism providing relative motion between the printhead and printing medium. This relative motion is in a direction substantially orthogonal to the scanning motion.

A normal advance of the mechanism is equal to the height of at least several pixel rows; however, the apparatus also includes some means for stepping the printing medium a distance of roughly one pixel row or less. For purposes of breadth and generality in discussing the invention, these means will be called simply the "stepping means".

The foregoing may constitute a description or definition of the first facet of the invention in its broadest or most general form. Even in this general form, however, it can be seen that this aspect of the invention significantly mitigates the difficulties left unresolved in the art.

In particular, this first facet of the invention can print images in which graininess at the top and bottom ends of a page is about the same as in other regions. Although this aspect of the invention in its broad form thus represents a significant advance in the art, it is preferably practiced in conjunction with certain other features or characteristics that further enhance enjoyment of overall benefits.

For example, it is preferred that the stepping means include some means for stepping the distance with no corresponding data shift. Alternatively or in addition, it also preferred that the stepping means comprise means for stepping by said distance between printhead scans when there is no normal advance; in this case the stepping means roughly equalize graininess between image regions with and without normal advance.

Another preference is that the stepping means include some means for stepping by the above-mentioned distance between printhead scans adjacent to at least one end of a page. In this case preferably the stepping means do specifically equalize graininess between image regions adjacent to and remote from the end of a page.

Still another preference is that the purpose of the above-described advance introduced by the stepping means is to deliberately misalign successive swaths. (That is, the apparatus includes means for deliberately misaligning successive swaths, and these means comprise the stepping means.)

In yet another preference, the stepping means include some means for stepping distances equal to successively different fractions of a pixel row, respectively, between successive pairs of swaths. In this case preferably the successively different fractions are progressively decreasing.

In one particularly convenient decreasing sequence the successively different fractions approximately follow a cosine function. Preferably the cosine function is:

$$I_{max}\cos\frac{I\cdot\pi}{2I_{max}}$$

where I counts swaths printed without normal advances, and $I_{max}$ is the largest value reached by I. In this situation preferably the stepping means comprise some means for initiating normal advances after I reaches $I_{max}$.

In an additional preference, still relative to the first major independent facet or aspect, the stepping means include some means for introducing a reciprocating motion into the positioning between the printhead and such printing medium. (In other words, the stepping is in the form of a reciprocation.) These means will be called, for reasons suggested earlier, the "introducing means".

This preference importantly advances the art. In particular, this small-amplitude reciprocation has the effect of injecting spatial noise into the resulting image. This deliberately created disturbance helps to eradicate or mitigate visible artifacts that arise from regularity in the printing process.

For example, such artifacts can include white space or double-printing due to nozzles that are not printing or are misdirected—or progressive migrating patterns such as developed in error diffusion. It can also include the repetitions of printmasks that are not large enough to escape from the repetition-sensitive angular range of the eye, as taught in the previously mentioned patent document of Garcia.

On the other hand, to the extent that the reciprocations introduced here are made random with respect to the printing process and image details, it is noteworthy that it is possible to inject excessive randomness. This too has been pointed out by Garcia, who shows that it can lead to undesirable visible granularity and that accordingly the ideal is a careful balance between excessive regularity and excessive randomness.

Within this reciprocation preference, certain additional subpreferences are significant. In particular, preferably the introducing means include means for providing the reciprocating motion in the form of a vibration.

In this case it is further preferred that the providing means comprise means for superimposing an oscillatory signal into electrical drive signals that control the scanning motion—or into electrical drive signals that control the printing-medium advance mechanism. Another basic preference is that the introducing means include some means for introducing the reciprocating motion in the form of successive offsets of substantially alternating direction.

In preferred forms of a second of its aspects, the invention is a method for printing desired images on a printing medium. The method operates by construction from individual marks formed in pixel row-and-column arrays, by a scanning printhead that operates in association with a printing-medium advance mechanism.

The method includes the steps of automatically operating the printing-medium advance mechanism under control of a programmed processor which follows this code—

```
// Machine start-up code
Frequency = 0.2244;
Phase = 0.0;
Ampiitude = 7.0;
...
// Start of page code
noAdvanceBefore = TRUE;
nPasses = 0;
...
// Compute advance for each print pass
paperAdvance = computeAdvance(imagepass);
if (paperAdvance == 0)
  if (noAdvanceBefore == TRUE)
    paperAdvance = Amplitude * cos(Frequency * nPasses + Phase);
else
  noAdvanceBefore = FALSE;
nPasses = nPasses + 1;
// Advancemedia
advanceMedia (paperAdvance);
...
```

The foregoing may constitute a description or definition of the second facet of the invention in its broadest or most general form. Even in this general form, however, it can be seen that this aspect of the invention too significantly mitigate the difficulties left unresolved in the art.

In particular, this form of the invention accomplishes imposition of a cosine function, such as described above, with a very minimal modification of otherwise conventional printer-control programming.

In preferred embodiments of third, fourth and fifth basic aspects or facets, the invention has certain elements in common with the first. More specifically, the invention is apparatus for printing desired images on a printing medium, by construction from individual marks formed in pixel row-and-column arrays.

As before the apparatus includes a printhead mounted for scanning motion to form marks in a multiple-pixel-row swath on the printing medium, and a printing-medium advance mechanism providing relative motion between the printhead and printing medium. Again this motion is in a direction substantially orthogonal to the scanning motion, and a normal advance of the mechanism is equal to the height of at least several pixel rows.

The <u>third</u> facet of the invention, however, expressly includes some means for roughly equalizing graininess between image regions with and without normal advance. These means, again for generality and breadth, will be called simply the "roughly equalizing means". The roughly equalizing means in turn include some means for stepping a distance of roughly one pixel row or less between printhead scans when there is no normal advance.

The foregoing may represent a description or definition of the third aspect or facet of the invention in its broadest or most general form. Even as couched in these broad terms, however, it can be seen that this facet of the invention importantly advances the art.

In particular, this aspect of the invention makes possible printing of images in which graininess is equalized—and therefore overall image quality is freer of undesirable artifacts—as between image regions with and without normal advance. Although the third major aspect of the invention thus significantly advances the art, nevertheless to optimize enjoyment of its benefits preferably the invention is practiced in conjunction with certain additional features or characteristics.

More specifically, the stepping means preferably comprise means for stepping by the indicated distance between printhead scans adjacent to at least one end of a page. In this case preferably the stepping means roughly equalize graininess between image regions adjacent to and remote from the end of a page.

Another preference is that the stepping means include some means for stepping—between successive pairs of swaths—distances respectively equal to successively different fractions of a pixel row. Here preferably the successively different fractions are progressively decreasing.

Still further preferably the successively different fractions approximately follow a cosine function. The cosine function in turn preferably is described by the following computer-program line.

```
paperAdvance=Amplitude*cos(Frequency*nPasses+Phase);
```

When these preferences are employed, preferably these definitions are used as well:

Amplitude is 7;

Frequency is 0.2244;

nPasses increments from zero through 7; and

Phase is zero.

In preferred embodiments of its fourth major independent facet or aspect, in addition to the common features mentioned just preceding discussion of the third aspect, the invention includes some means for stepping the printing-medium advance mechanism a distance of roughly one pixel row or less. This is done to deliberately misalign successive swaths between printhead scans <u>remote from</u> both ends of a page.

It will be noted that this aspect of the invention is thus counter to some preferences introduced above for the first and third aspects of the invention. This fourth facet of the invention accordingly is not aimed at mitigating top-of-page or bottom-of-page artifacts.

The foregoing may represent a description or definition of the fourth aspect or facet of the invention in its broadest or most general form. Even as couched in these broad terms, however, it can be seen that this facet of the invention importantly advances the art.

In particular, this aspect of the invention cures or mitigates the repetitive overprinting of particular nozzles by specific other nozzles. To the extent that some undesired regularity remains, in regard to such overprinting, the fourth facet of the invention perturbs that regularity by at least strongly affecting the frequency of the beats between different periodicities within the printer mechanism.

These mechanism periodicities include particularly, but not exclusively, software-generated beats. Such software-generated interferences include, for example interactions between dither-mask and printmask periodicities as explained in the previously mentioned patent document of Borrell.

Although the fourth major aspect of the invention thus significantly advances the art, nevertheless to optimize enjoyment of its benefits preferably the invention is practiced in conjunction with certain additional features or characteristics. In particular, several of the preferences mentioned above for the previously introduced aspects of the invention apply here as well.

All of the foregoing operational principles and advantages of the present invention will be more fully appreciated upon consideration of the following detailed description, with reference to the appended drawings, of which:

BRIEF DESCRIPTION OF THE DRAWINGS

FIG. 2 is a highly schematic block diagram of a printer/plotter in which such microadvances—as well as other, conceptually related microadvances—are advantageously implemented, particularly showing key signals flowing from and to one or more digital electronic microprocessors to effectuate printing;

DETAILED DESCRIPTION OF THE PREFERRED EMBODIMENTS

1. End-of-Page Image Artifacts

Figure 1:
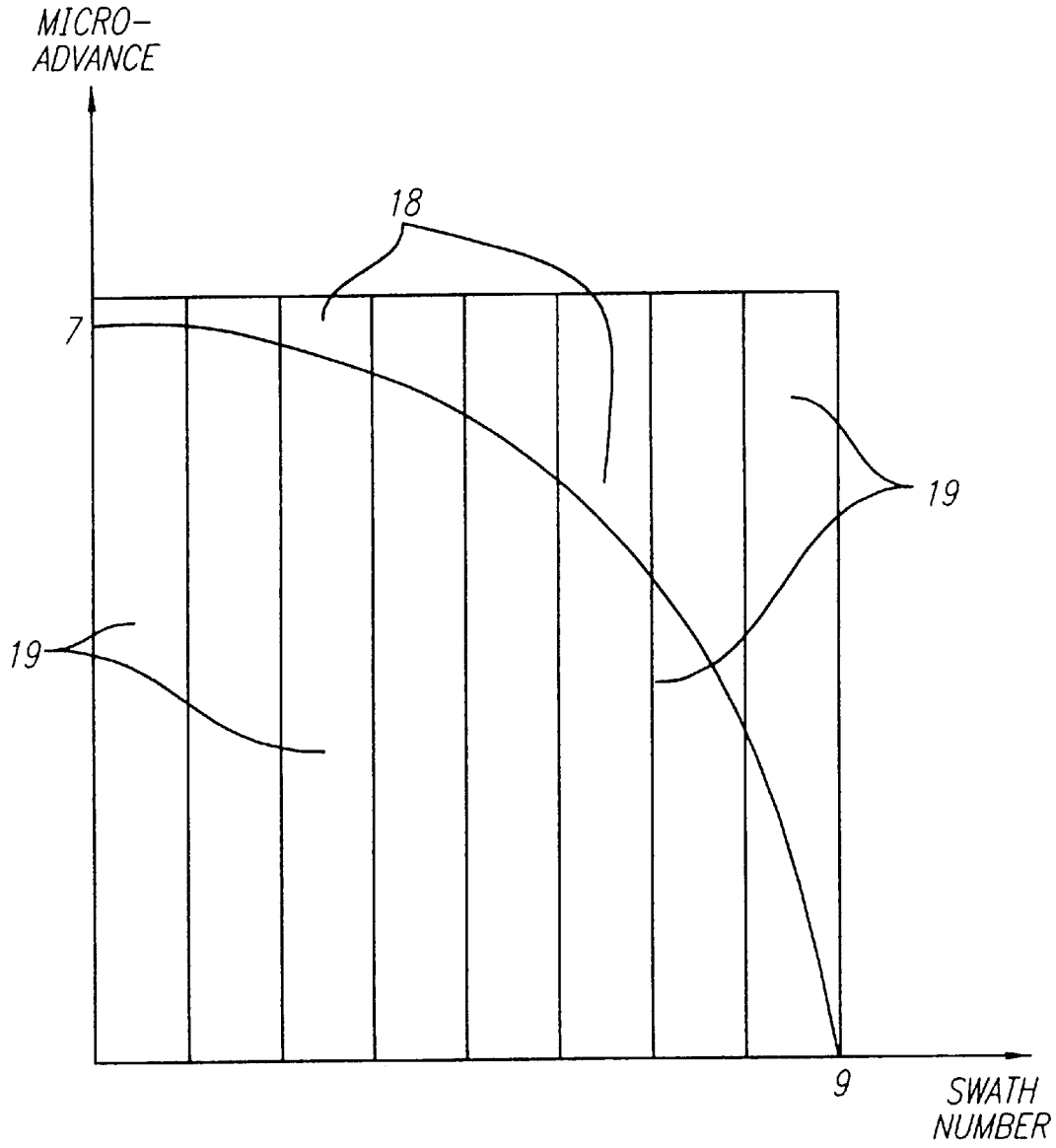
FIG. 1 is a graph showing a size progression of microadvances near the top end of a page according to one preferred aspect and embodiment of the invention.

The first few top-of-page swaths printed in some incremental printing systems, such as certain inkjet printers of the Hewlett Packard Company, are performed without advancing the paper. The pen is masked in such a way that only nozzles of the first swath are printed.

The mask is then stepped and the subsequent swath is printed while increasing the density of the first swath. This process is iterated until essentially all the nozzles in the pen are fired, and then the normal paper advance is initiated.

Because of this process, the first few swaths contain a graininess pattern that is unlike the rest of the image. The change in graininess produces a print-quality defect at the top end of the page, as outlined earlier.

The sequencing at the bottom end of the page is the reverse. The result, however, is a closely analogous defect.

Some Hewlett Packard products have performed a small advance (e.g., a few dot rows) to produce graininess in the two end-of-page (EOP) regions that is similar to the graininess in the intermediate regions. This small advance is also performed in the swath buffer, so that the image features are printed correctly. In effect the procedure simulates averaging to reduce "noise" or grain.

Other products, however, because of limitations established by, for example, an application-specific integrated circuit (ASIC), cannot perform small advances. The smallest advance possible that coincides with an image advance in the swath buffer equals the height of sixty-four nozzles along the pen.

2. Eliminating "EOP" And Other Artifacts

In order to make the graininess in the first swath similar to the rest of the image, the present invention provides a small movement—which may be termed a "microadvance"—in the paper axis. Although the primary motivation for this algorithm is to improve EOP problems, it can be used throughout the image to mitigate banding by increasing graininess.

This movement is actuated between passes, most preferably whenever there is no paper advance associated with printing a swath. It can, however, also be done between advances.

The profile that the movement follows, for successive microadvance sizes, is preferably sinusoidal. Numerous profiles have been tested.

The profile 18 (FIG. 1) that was chosen shows the best improvement in print quality for the EOP problem. The function is $7 \cdot \cos(0.2244\,\underline{I})$, in which $\underline{I}$ is a counter for normal moves 19 of zero size. That is, in an eight-pass print mode the first seven use zero moves. At the top of the page, this function forms the succession of movements represented in FIG. 1.

As shown, the amplitude of this function, expressed in print-medium encoder units (EU), is seven. The encoder units run somewhat over 700 EU/mm (18,000 EU/inch); thus the amplitude—which as can be seen is also the largest excursion used in any single microadvance—is roughly 7/700 mm, or 0.01 mm (7/18,000=0.0004 inch).

In a representative printer the pixel-row spacing in the printing-medium advance direction is thirty EU. Hence the amplitude is 7/30≈¼ (one-quarter) pixel row

3. Programming

Advantageously the behavior illustrated in FIG. 1 and discussed above is produced by modifications to the standard coding which operates the printer through one or more processors. From the code excerpts reproduced here, those skilled in the field will recognize that the desired modifications are extremely simple.

Moreover they are not disruptive to the normal operation of the program—either in the EOP zones or elsewhere. To those skilled in this field and particularly in the programming aspects of the field, these excerpts will be self explanatory:

```
// Machine start-up code
Frequency = 0.2244;
Phase = 0.0;
Amplitude = 7.0;
...
// Start of page code
noAdvanceBefore = TRUE;
nPasses = 0;
...
// Compute advance for each print pass
// NOTE: computeAdvance returns 0 when not necessary
//          to move the medium for next printing pass.
paperAdvance = computeAdvance(imagePass);
if (paperAdvance == 0)
{
  if (noAdvanceBefore == TRUE)
```

-continued

```
    {
      // Calculate micro advance method if medium
      // not advanced before and for this print
      // pass it need not be moved.
      paperAdvance = Amplitude * cos(Frequency *
                                    nPasses + Phase);
    }
{
else
{
  // Since medium is to be moved, algorithm will not
  // be applied until the beginning of the next page
  // To disable micro advance mechanism printer,
  // change from noAdvanceBefore equals to TRUE to
  // noAdvanceBefore equals to FALSE
  noAdvanceBefore = FALSE;
}
nPasses = nPasses + 1;      // Increment number of
printing passes
// And finally advance media
advanceMedia (paperAdvance);
...
```

4. Additional Benefits

As mentioned above, numerous profiles have been tested. In addition to optimizing solution of the EOP problem, the testing revealed that different profiles are able to mitigate other problems—which have also been mentioned above.

Even in the middle of the page, banding can be improved by the present invention. For this purpose it will sometimes be helpful to select types of ramp profiles other than the sinusoidal one discussed earlier.

Those skilled in the field will find that ideal selections vary strongly with the type of printer, head, ink and print-modes in use, as well as characteristics of the image—but that identification and selection of an ideal profile for any given case is extremely easy and straight-forward. Nevertheless some general principles can be stated here.

Using different microadvance sizes for the successive movements is beneficial. It helps hide the process from the eye.

Bidirectional movement is awkward and therefore best avoided, except for the reciprocation or vibration mode mentioned earlier. In that mode a reciprocatory signal is simply superimposed on the motor drive signals—most straightforwardly on a software basis, but analog signals and superposition are also within the scope of the present invention.

Linear ramps, arbitrary steps etc. can all be used. A monotonically decreasing function is advisable, because beginning with the maximum motion helps take out backlash in the system.

5. Microprocessor Hardware (a) Basic processing options—Data-processing arrangements for the present invention can take any of a great variety of forms. To begin with, image-processing and printing-control tasks 332, 40 (FIGS. 2 and 3) can be shared among one or more processors in each of the printer 320 and an associated computer and/or raster image processor 30.

A raster image processor ("RIP") is nowadays often used to supplement or supplant the role of a computer or printer—or both—in the specialized and extremely processing-intensive work of preparing image data files for use, thereby relieving the printer and computer for other duties. Processors in a computer or RIP typically operate a program known as a "printer driver".

These several processors may or may not include general-purpose multitasking digital electronic microprocessors (usually found in the computer 30), which run software; or general-purpose dedicated processors (usually found in the printer 320) which run firmware; or application-specific integrated circuits (ASICs, also usually in the printer). As is well-understood nowadays, the specific distribution of the tasks of the present invention among all such devices, and still others not mentioned and perhaps not yet known, is primarily a matter of convenience and economics.

On the other hand, sharing is not required. If preferred the system may be designed and constructed for performance of all data processing in one or another of the FIG. 2 or 3 modules—in particular, for example, the printer 320.

Regardless of the distributive specifics, the overall system typically includes a memory 232*m* for holding color-corrected image data. As the drawings suggest, these data may be developed in the computer or raster image processor, for example with specific artistic input by an operator, or may be received from an external source.

Ordinarily the input data proceed from image memory 232*m* to an image-processing stage 332 that includes some form of program memory 333—whether card memory or hard drive and RAM, or ROM or EPROM, or ASIC structures. The memory 232*m* provides instructions 334, 335 for automatic operation of rendition 336 and printmasking 338.

Image data cascades 335, 337 through these latter two stages 336, 338 in turn, resulting in new data 339 specifying the colorants to be deposited in each pixel, in each pass of the printhead carriage 20 over the printing medium 41. It remains for these data to be interpreted to form:

- actual printhead-actuating signals 53 (for causing precisely timed and precisely energized ink ejection or other colorant deposition 54),
- actual carriage-drive signals 57 (for operating a carriage-drive motor 35 that produces properly timed motion 55 of the printhead carriage across the printing medium), and
- actual print-medium-advance signals 46 (for energizing a medium-advance motor 42 that similarly produces suitably timed motion of the print-medium platen 43 and thereby the medium 41).

Such interpretation is performed in the printing control module 40. In addition the printing control module 40 may typically be assigned the tasks of receiving and interpreting the encoder signal 52 fed back from the encoder sensor 233.

The printing-control stage 40 necessarily contains electronics and program instructions for interpreting the colorant-per-pixel-per-pass information 339. Most of this electronics and programming is conventional, and represented in the drawing merely as a block 81 for driving the carriage and pen—plus a normal-advance subblock 83 within the printing-medium advance drive block 82. These blocks in fact may be regarded as providing essentially all of the conventional operations of the printing control stage 40.

Figure 3:
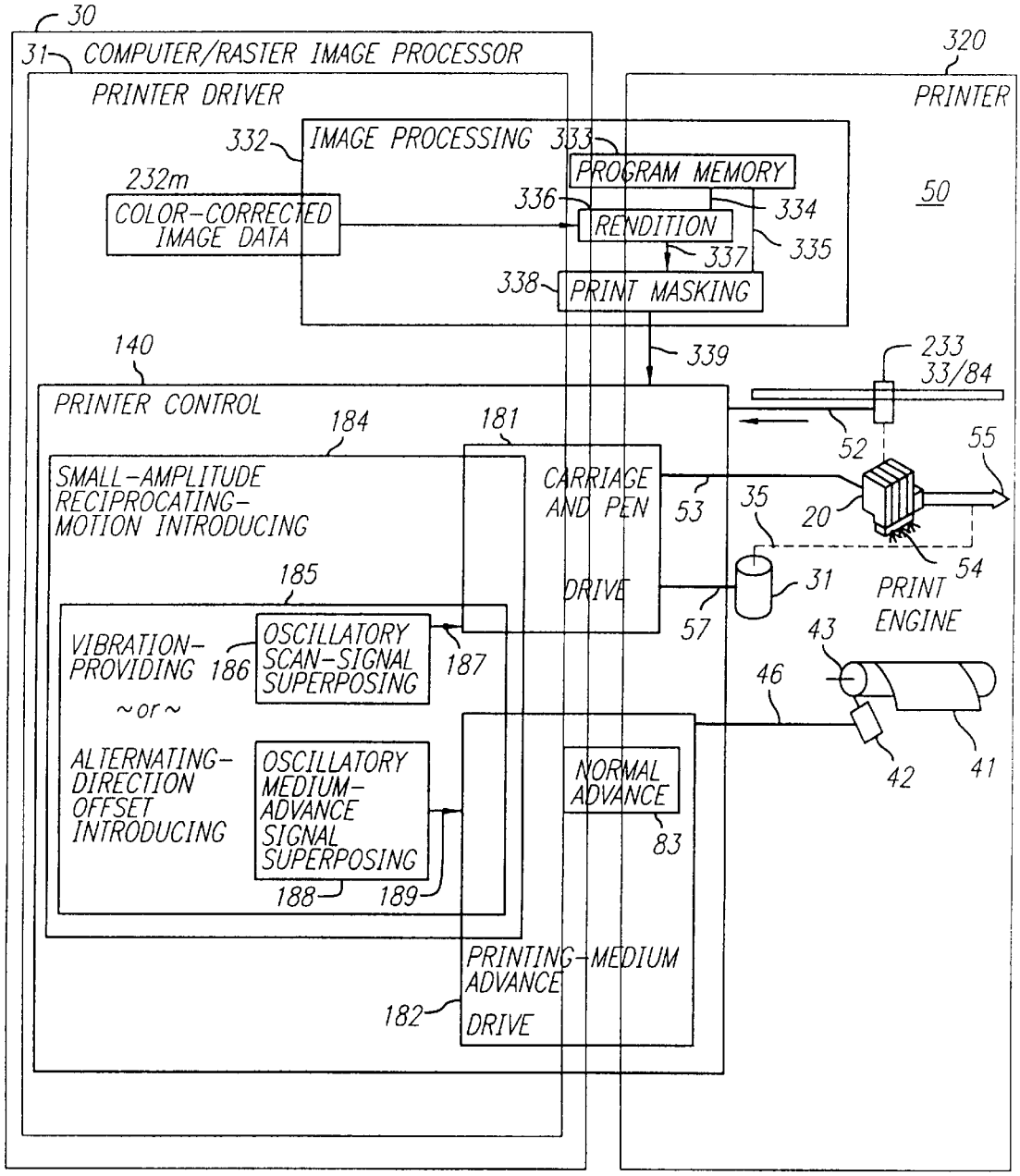
FIG. 3 is a like diagram of a printer/plotter in which bidirectional or reciprocatory microadvances are implemented as part of another preferred aspect and embodiment of the invention.

(b) Provisions for equalizing graininess—Also appearing in FIGS. 2 and 3 are certain specific modules and associated data-flow paths 84–98 implementing the present invention. Certain of these illustrated specific functions may be alternatives, rather than subsystems that must necessarily coexist within any single printer/computer/RIP system.

Within the advance drive block 82 preferably are means 86 for roughly equalizing graininess between certain image regions. These means particularly include stepping means 91, which supplement the normal-advance block 83 in formulating signals 46 to the printing-medium advance mechanism 42, 43.

As FIG. 2 suggests and as mentioned above, the stepping means 91 preferably perform their various functions selectively at times when there is no data shift 331. On the other hand, variants within the scope of the invention can instead perform the same or analogous functions selectively at times when there is a data shift 331.

Accordingly the drawing includes a module 87 that symbolizes receipt of information 85 about existence of a data shift 331. The module 87 responds with generation of control signals 88 to effect either synchronization or desynchronization of the microadvance stepping, as preferred by system designers, with such data shift.

Analogously the stepping means 91 preferably perform their functions selectively at times correlated with occurrence of a normal advance of the printing medium—i.e., again either at times when there is no normal advance or at times when there is a normal advance. Thus the drawing incorporates another module 97 that symbolizes receipt of information 96 about existence of a normal advance. This module 97 responds with generation of control signals 98 to effectuate either synchronization or desynchronization of the microadvance stepping, as preferred, with such normal advance.

The stepping means 91 advantageously include some means 92 for stepping between scans, selectively when the system is printing near at least one end of a page. Analogous means (not shown) may—for other purposes—instead step between scans selectively when the system is printing between the two EOP regions.

Also the stepping means 91 preferably include some means 93 for stepping by distances that are successively different. As indicated in the drawing these distances may, for instance, be progressively decreasing, and in particular may roughly follow a cosine function, as indicated in FIG. 1. Alternatively, as also indicated in the drawing, the function used may be substantially arbitrary.

Further still, the stepping means 91 preferably include some means 94 for initiating normal advances—after the previously mentioned counter I of microadvances has run out. Finally the stepping means 91 advantageously include some means 95 for making the microadvance distance a fraction of a pixel row.

(c) Provisions for reducing banding—Preferred embodiments of another above-introduced aspect of the invention include, within the printing-control block 140 (FIG. 3), some means 184 for introducing a reciprocating motion of small amplitude. As shown, these means 184 can be associated with, or can in part be components of, either the carriage and pen drive 181 or the printing-medium advance drive 182—or both.

The reciprocating-motion introducing means 184 in turn include means 185 for providing vibration or introducing an offset of alternating direction, in operation of the print engine 50. For this purpose, these vibration or offset means 185 may include a module 186 that injects into the carriage drive module 181 an oscillatory signal 187 for superposition upon the carriage-scanning drive signal 57.

Alternatively, or in addition, the vibration or off-set means 185 may include a module 188 that injects into the print-medium drive 182 an oscillatory signal 189. This electrical oscillation 190 is for superposition upon the signal from the normal-advance subblock 83, in generating the print-medium advance signal 46.

6. Method

The several forms of the invention may also be seen in terms of method, as distinguished from apparatus. Because the invention is implemented largely through programmed hardware as described above, the method modules or steps correspond very closely to the modules indicated as hardware in FIGS. 2 and 3—and therefore should be regarded as illustrated by those drawings. The actual programming of certain preferred embodiments and aspects has been introduced in more specific form above.

7. Basic Hardware for Implementing the Invention

Figure 4:
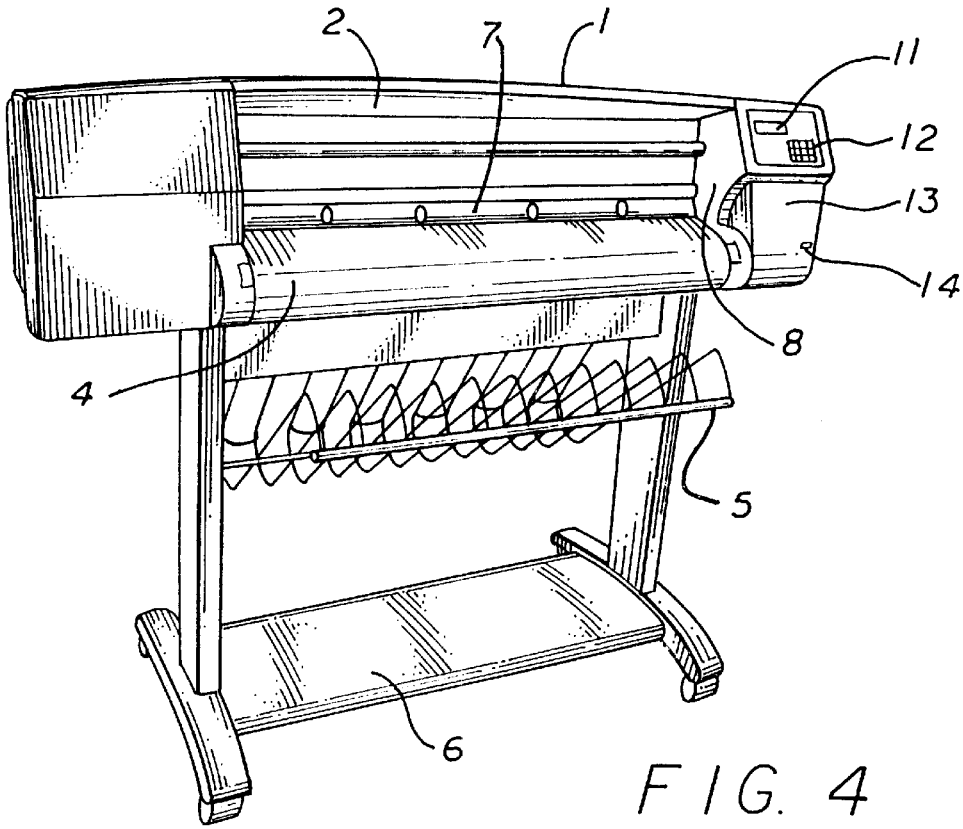
FIG. 4 is an isometric or perspective exterior view of a large-format printer-plotter which is a preferred embodiment of the present invention, and which can be used to implement the features of FIGS. 1 through 3.

The preferred printer/plotter includes a main case 1 (FIG. 4) with a window 2, and a left-hand pod 3 that encloses one end of the chassis. Within that pod are carriage-support and -drive mechanics and one end of the printing-medium advance mechanism, as well as a pen-refill station containing supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included are a lever 8 for control of the gripping of the print medium by the machine.

A front-panel display 11 and controls 12 are mounted in the skin of the right-hand pod 13. That pod encloses the right end of the carriage mechanics and of the medium advance mechanism, and also a printhead cleaning station. Near the bottom of the right-hand pod for readiest access is a standby switch 14.

Figure 5:
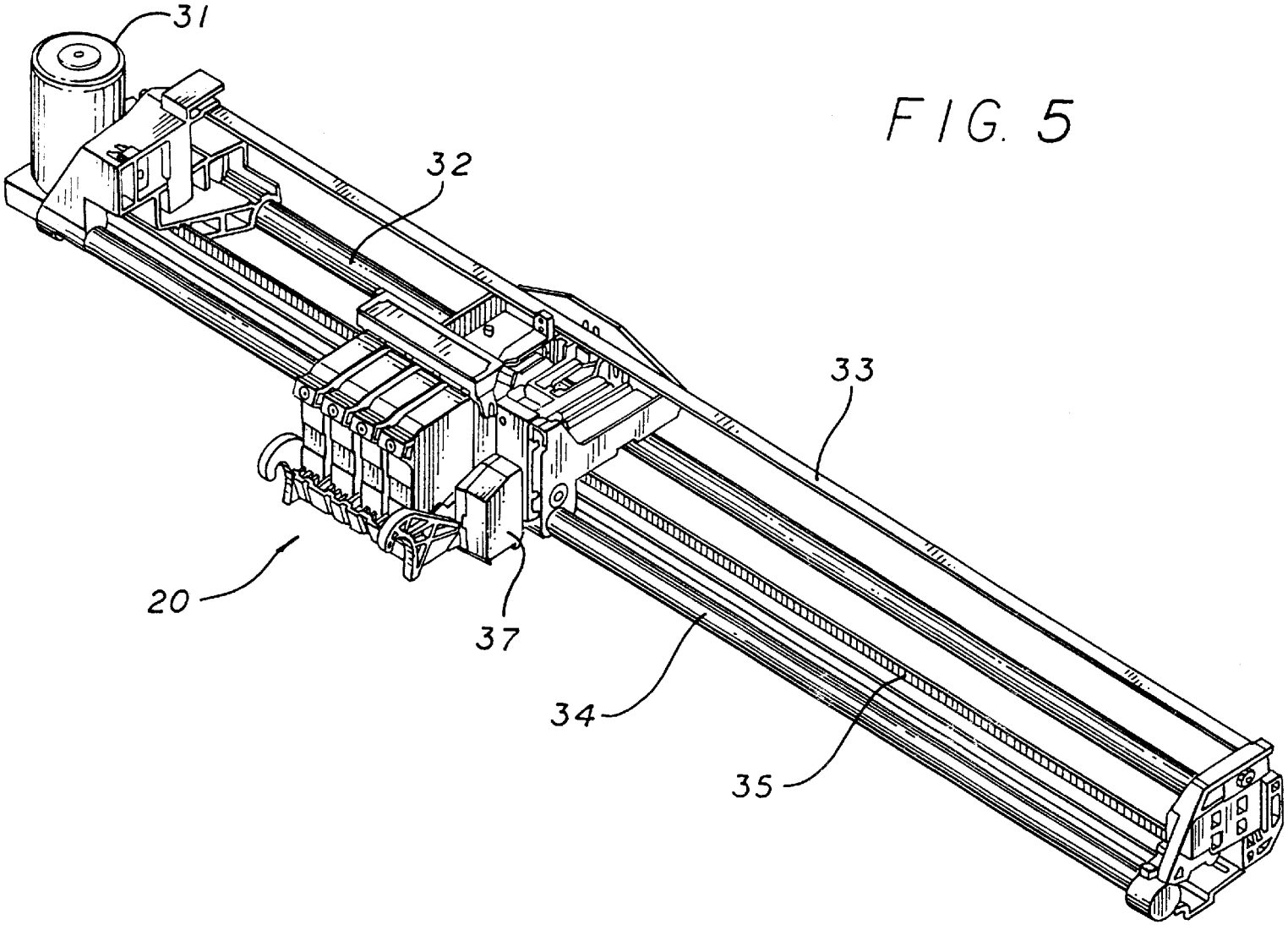
FIG. 5 is an isometric view, taken from front above left, of a carriage and carriage-drive mechanism which is mounted within the case or cover of the FIG. 4 device.

Within the case 1 and pods 3, 13 the carriage assembly 20 (FIG. 5) is driven in reciprocation by a motor 31—along dual support and guide rails 32, 34—through the intermediary of a drive belt 35. The motor 31 is under the control of signals 57 from a digital electronic microprocessor (essentially all of FIGS. 2 or 3 except the print engine 50). In a block diagrammatic showing, the carriage assembly 20 travels to the right 55 and left (not shown) while discharging ink 54.

A very finely graduated encoder strip 33 is extended taut along the scanning path of the carriage assembly 20, and read by an automatic optoelectronic sensor 133, 233 to provide position and speed information 52 for the microprocessor. (In FIGS. 2 and 3), signals in the print engine are flowing from left to right except the information 52 fed back from the encoder sensor 233—as indicated by the associated leftward arrow.)

The codestrip 33 thus enables formation of color ink-drops at ultrahigh resolution (typically 24 pixels/mm) and precision, during scanning of the carriage assembly 20 in each direction.

Figure 7:
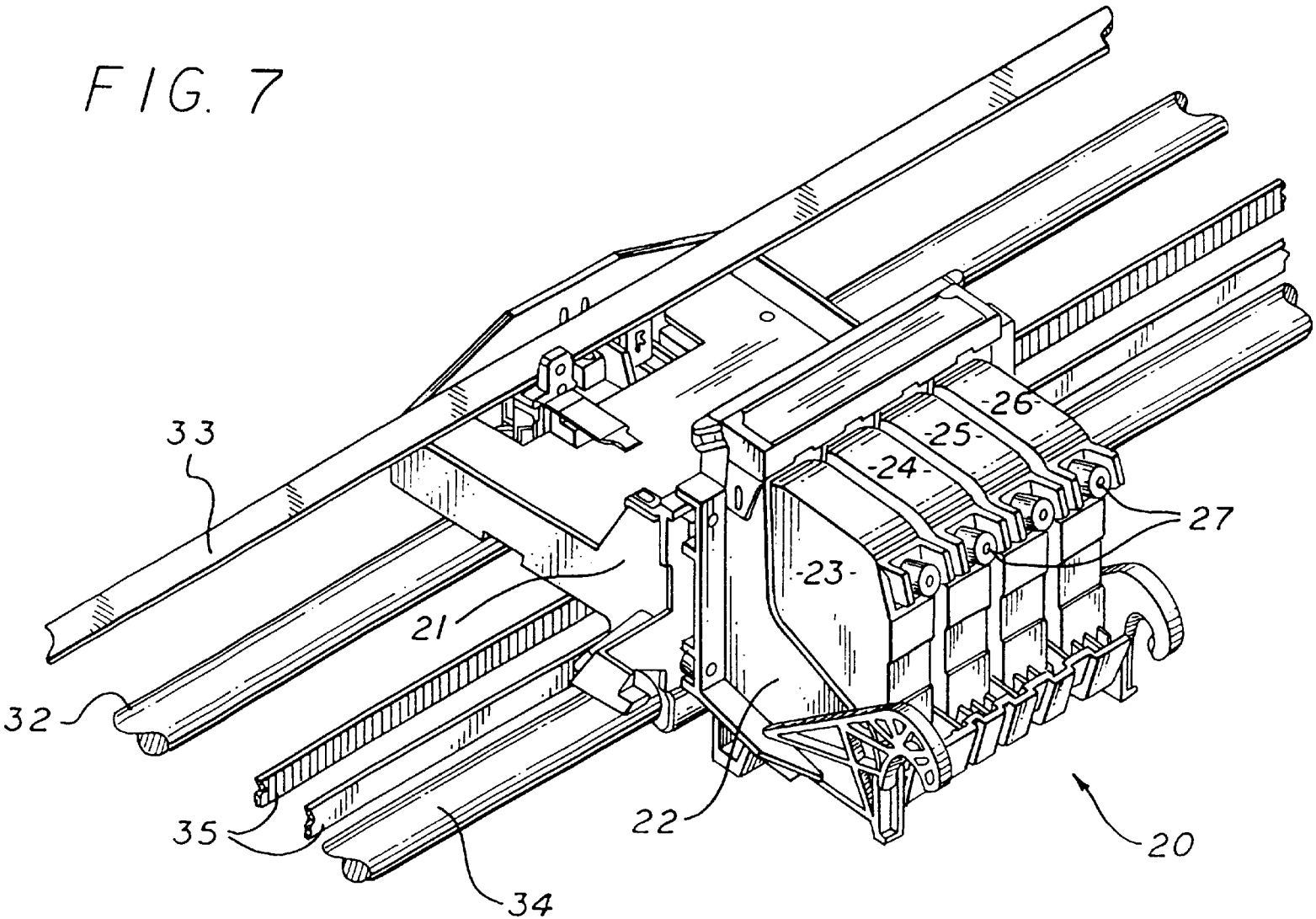
FIG. 7 is a like but more-detailed view of the FIG. 5 carriage, showing the printheads or pens which it carries.

A currently preferred location for the encoder strip 33 is near the rear of the carriage tray (remote from the space into which a user's hands are inserted for servicing of the pen refill cartridges). Immediately behind the pens is another advantageous position for the strip 36 (FIG. 7). The encoder sensor 133 (for use with the encoder strip in its forward position 33) or 233 (for rearward position 36) is disposed with its optical beam passing through orifices or transparent portions of a scale formed in the strip.

Figure 6:
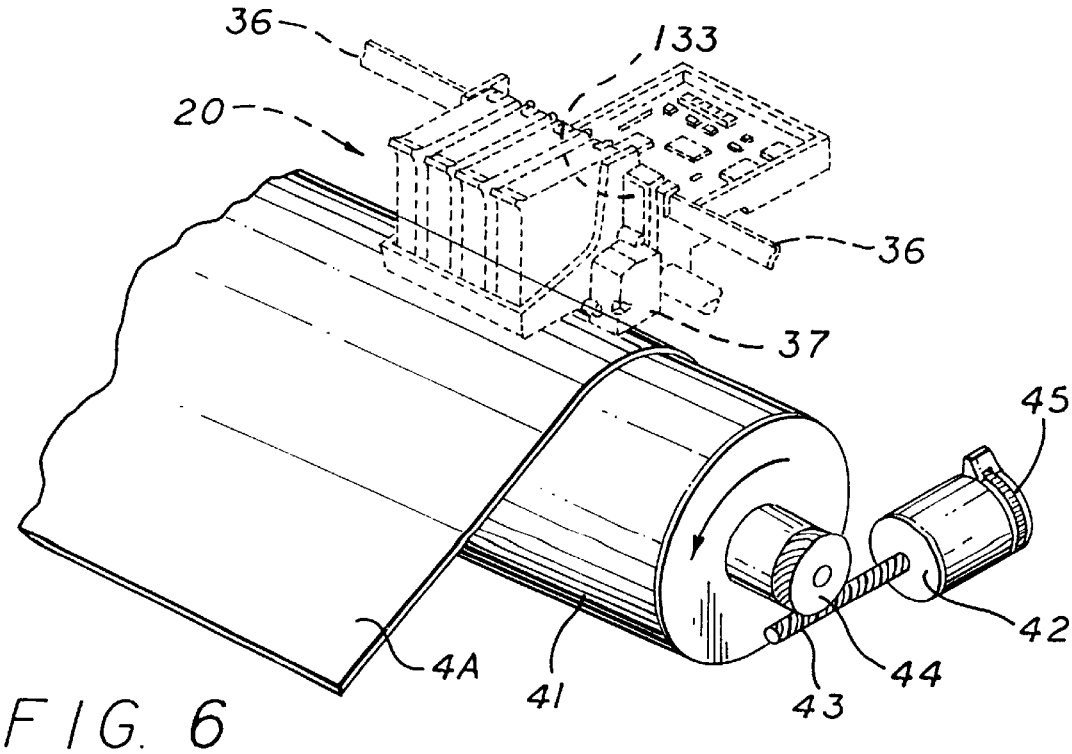
FIG. 6 is a like view of a printing-medium advance mechanism which is also mounted within the case or cover of the FIG. 4 device.

A cylindrical platen 41 (FIG. 6)—driven by a motor 42, worm 43 and worm gear 44 under control of signals 46 from the processor 15—rotates under the carriage-assembly 20 scan track to drive sheets or lengths of printing medium 4A in a medium-advance direction perpendicular to the scanning. Print medium 4A is thereby drawn out of the print-medium roll cover 4, passed under the pens on the carriage 20 to receive inkdrops 54 for formation of a desired image, and ejected into the print-medium bin 5.

The carriage assembly 20 includes a previously mentioned rear tray 21 (FIG. 7) carrying various electronics. It also includes bays 22 for preferably four pens 23–26 holding ink of four different colors respectively—preferably cyan in the leftmost pen 23, then magenta 24, yellow 25 and black 26.

Figure 8:
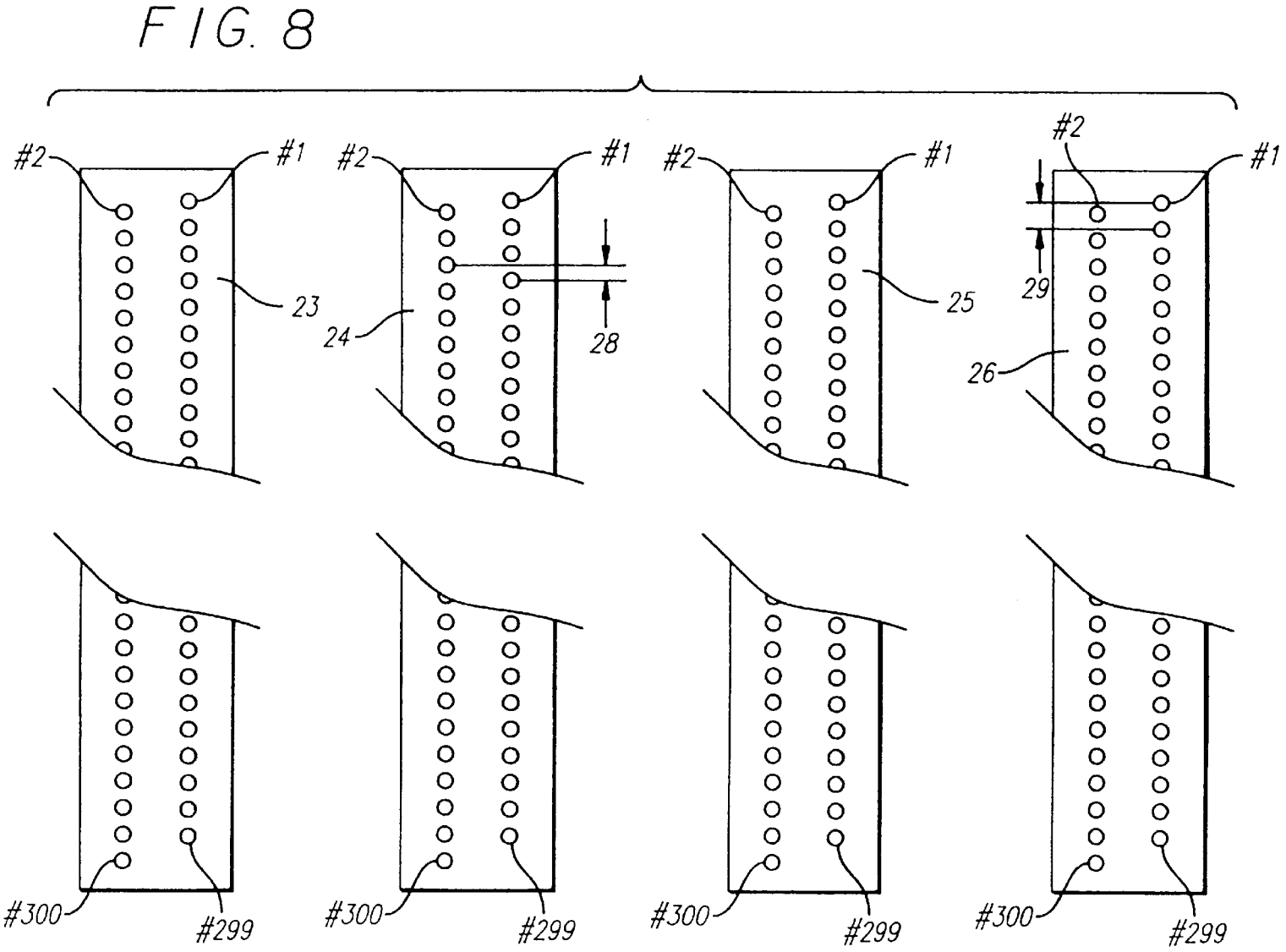
FIG. 8 is a bottom plan of the printheads or pens, showing their nozzle arrays.

Each of these pens, particularly in a large-format printer/plotter as shown, preferably includes a respective ink-refill valve 27. The pens, unlike those in earlier mixed-resolution printer systems, all are relatively long and all have nozzle spacing 29 (FIG. 8) equal to one-twelfth millimeter—along each of two parallel columns of nozzles. These two columns contain respectively the odd-numbered nozzles 1 to 299, and even-numbered nozzles 2 to 300.

The two columns, thus having a total of one hundred fifty nozzles each, are offset vertically by half the nozzle spacing, so that the effective pitch of each two-column nozzle array is approximately one-twenty-fourth millimeter. The natural resolution of the nozzle array in each pen is thereby made approximately twenty-four nozzles (yielding twenty-four pixels) per millimeter, or 600 per inch.

Preferably black (or other monochrome) and color are treated identically as to speed and most other parameters.

In the preferred embodiment the number of printhead nozzles used is always two hundred forty, out of the three hundred nozzles (FIG. 8) in the pens.

This arrangement allows for software/firmware adjustment of the effective firing height of the pen over a range of ±30 nozzles, at approximately 24 nozzles/mm, or ±30/24= ±1¼ mm. This adjustment is achieved without any mechanical motion of the pen along the print-medium advance direction.

Alignment of the pens can be automatically checked and corrected through use of the extra nozzles. As will be understood, the invention is amenable to use with a very great variety in the number of nozzles actually operated.

The above disclosure is intended as merely exemplary, and not to limit the scope of the invention—which is to be determined by reference to the appended claims.

What is claimed is:

1. Apparatus for printing images on a printing medium, by construction from individual marks formed in pixel row-and-column arrays; said apparatus comprising:

a printhead mounted for scanning motion and having multiple printing elements to form marks in a multiple-pixel-row swath on the printing medium;

a printing-medium advance mechanism providing relative motion between the printhead and printing medium in a direction substantially orthogonal to the scanning motion, wherein a normal advance of said mechanism is equal to the height of at least several pixel rows; and means for stepping the printing-medium advance mechanism a distance of roughly one pixel row or less, between two successive scanning motions of the printhead, both of said successive motions being for printing with substantially all marking elements of the printhead that are not reserved for alignment with other heads.

2. The apparatus of claim 1, wherein:

the stepping means comprise means for stepping said distance with no corresponding data shift.

3. The apparatus of claim 1, wherein:

the stepping means comprise means for stepping said distance between printhead scans when there is no normal advance.

4. The apparatus of claim 3, wherein:

said stepping means roughly equalize graininess between image regions with and without normal advance.

5. The apparatus of claim 1, wherein:

the stepping means comprise means for stepping said distance between printhead scans adjacent to at least one end of a page.

6. The apparatus of claim 5, wherein:

said stepping means roughly equalize graininess between image regions adjacent to and remote from at least one end of a page.

7. The apparatus of claim 1, wherein:

the stepping means comprise means for stepping distances that are successively different, respectively, between successive pairs of swaths.

8. The apparatus of claim 7, wherein:

the successively different distances are progressively decreasing.

9. The apparatus of claim 7, wherein:

the successively different distances follow a substantially arbitrary function.

10. The apparatus of claim 7, wherein:

the successively different distances approximately follow a cosine function.

11. The apparatus of claim 10, wherein the cosine function is:

$$I_{\max}\cos\frac{I\cdot\pi}{2I_{\max}}$$

where $\underline{I}$ counts swaths printed without normal advances, and $\underline{I}_{max}$ is the largest value reached by $\underline{I}$.

12. The apparatus of claim 11, wherein:

the stepping means comprises means for initiating normal advances after $\underline{I}$ reaches $\underline{I}_{max}$.

13. The apparatus of claim 1, wherein:

the stepping means comprise means for making said distance a fraction of a pixel row.

14. The apparatus of claim 1:

further comprising means for deliberately misaligning successive swaths; and wherein the deliberately-misaligning means comprise said stepping means.

15. The apparatus of claim 1, wherein:

the stepping means comprise means for introducing said stepping in the form of a reciprocating motion.

16. The apparatus of claim 15, wherein:

the introducing means comprise means for providing said reciprocating motion in the form of a vibration.

17. The apparatus of claim 16, wherein:

the providing means comprise means for superimposing an oscillatory signal into electrical drive signals that control said scanning motion.

18. The apparatus of claim 16, wherein:

the providing means comprise means for superimposing an oscillatory signal into electrical drive signals that control said printing-medium advance mechanism.

19. The apparatus of claim 15, wherein:

the introducing means comprise means for introducing said reciprocating motion in the form of successive off-sets of substantially alternating direction.

20. Apparatus for printing desired images on a printing medium, by construction from individual marks formed in pixel row-and-column arrays; said apparatus comprising:

a printhead mounted for scanning motion and having multiple printing elements to form marks in a multiple-pixel-row swath on the printing medium;

a printing-medium advance mechanism providing relative motion between the printhead and printing medium in a direction substantially orthogonal to the scanning motion, wherein a normal advance of said mechanism is equal to the height of at least several pixel rows; and means for roughly equalizing graininess between image regions with and without normal advance;

wherein said roughly equalizing means comprise means for stepping the printing medium advance mechanism a distance of roughly one pixel row or less between two successive scanning motions of the printhead when there is no normal advance, both of said successive motions being for printing with substantially all marking elements of the printhead that are not reserved for alignment with other heads.

21. The apparatus of claim 20, wherein:

the stepping means comprise means for stepping by said distance between printhead scans adjacent to at least one end of a page.

22. The apparatus of claim 20, wherein:

said end-adjacent stepping means roughly equalize graininess between image regions adjacent to and remote from the end of a page.

23. The apparatus of claim 20, wherein:

the stepping means comprise means for stepping, between successive pairs of swaths, distances respectively equal to successively different fractions of a pixel row.

24. The apparatus of claim 23, wherein:

the successively different fractions are progressively decreasing.

25. The apparatus of claim 24, wherein:

the successively different distances follow a substantially arbitrary function.

26. The apparatus of claim 24, wherein:

the successively different fractions approximately follow a cosine function.

27. The apparatus of claim 24, wherein:

the cosine function is described by the following computer-program line

```
paperAdvance=Amplitude*cos(Frequency*nPasses+Phase).
```

28. The apparatus of claim 27, wherein:

Amplitude is 7;

Frequency is 0.2244;

nPasses increments from zero through 7; and

Phase is zero.

29. The apparatus of claim 20, wherein:

the stepping means comprises means for making said distance equal to a fraction of a pixel row.

30. A method for printing images on a printing medium, by construction from individual marks formed in pixel arrays, using a printhead mounted for scanning motion, and using a printing-medium advance mechanism that provides relative motion between the head and medium in a direction substantially orthogonal to the scanning motion; said method being independent of correcting any printhead rotational misalignment, and comprising the steps of:

scanning the printhead across the medium plural times to form the image as marks in successive multiple-pixel-row swaths on the printing medium;

operating the advance mechanism to provide said relative motion, between the plural scanning steps, wherein a normal operation of said mechanism operates through a distance equal to the height of at least several pixel rows; and independent of correcting any printhead rotational misalignment, also operating the advance mechanism through a distance of roughly one pixel row or less, between two successive scanning motions of the printhead.

31. The method of claim 30, comprising the step of:

adding graininess to the image;

wherein said graininess-adding step comprises said also-operating step.

32. The method of claim 31, wherein:

the graininess-adding step is performed selectively in an end-of-page region.

33. The method of claim 31, wherein:

the graininess-adding step is performed selectively in at least one region where banding otherwise would be conspicuous.

34. The method of claim 33, wherein:

the region is between end-of-page regions.

35. The method of claim 31, wherein:

the graininess-adding step is performed throughout substantially the entire image.

36. A method for printing images with quality enhanced by increased graininess, on a printing medium, by construction from individual marks formed in pixel arrays, using a printhead mounted for scanning motion, and using a printing-medium advance mechanism that provides relative motion between the head and medium in a direction substantially orthogonal to the scanning motion; said method comprising the steps of:

scanning the printhead across the medium plural times to form the image as marks in successive multiple-pixel-row swaths on the printing medium;

operating the advance mechanism to provide said relative motion, between the plural scanning steps, wherein a normal operation of said mechanism operates through a distance equal to the height of at least several pixel rows; and adding graininess to the image by operating the advance mechanism through a distance of roughly one pixel row or less, between two successive scanning motions of the printhead.

37. The method of claim 36, wherein:

the graininess-adding step is performed selectively in at least one region where graininess otherwise would be anomalously low.

38. The method of claim 37, wherein:

the region is an end-of-page region.

39. The method of claim 36, wherein:

the region is a region where banding otherwise would be conspicuous.

40. The method of claim 39, wherein:

the region is between end-of-page regions.

41. The method of claim 39, wherein:

the region is substantially the entire image.

* * * * *